US006325111B2

(12) United States Patent
Nakada et al.

(10) Patent No.: US 6,325,111 B2
(45) Date of Patent: Dec. 4, 2001

(54) METHOD AND APPARATUS FOR DRIVING SELVEDGE FORMING DEVICE IN WEAVING MACHINE

(75) Inventors: Akihiko Nakada; Shigeharu Sawada, both of Ishikawa-ken (JP)

(73) Assignee: Tsudakoma Kogyo Kabushiki Kaisha (JP)

( * ) Notice: Subject to any disclaimer, the term of this patent is extended or adjusted under 35 U.S.C. 154(b) by 0 days.

(21) Appl. No.: 09/772,242

(22) Filed: Jan. 29, 2001

(30) Foreign Application Priority Data

Feb. 22, 2000 (JP) ..... 12-044871

(51) Int. Cl.[7] ..... D03D 47/00
(52) U.S. Cl. ..... 139/434
(58) Field of Search ..... 139/434, 435.5

(56) References Cited

U.S. PATENT DOCUMENTS 4,957,144 9/1990 Watanabe et al. ..... 139/434
5,067,527 * 11/1991 De Jager ..... 139/435.2
5,158,119 10/1992 Pezzoli et al. ..... 139/434
5,322,089 * 6/1994 Yamada ..... 139/435.2
5,440,495 * 8/1995 Sainen et al. ..... 139/435.1
5,816,295 * 10/1998 Sugita et al. ..... 139/435.2
6,129,123 * 10/2000 Ludwig et al. ..... 139/434

FOREIGN PATENT DOCUMENTS 6253450 3/1987 (JP) .
2112446 4/1990 (JP) .
2501845 3/1996 (JP) .
9828474 7/1998 (WO) .

* cited by examiner

*Primary Examiner*—Andy Falik
(74) *Attorney, Agent, or Firm*—Webb Ziesenheim Logsdon Orkin & Hanson, P.C.

(57) ABSTRACT

In a selvedge forming device, the operation condition for operating at least one of the selvedge forming elements contributing to the selvedge formation is set in advance in correspondence to a weaving condition, and the selvedge forming device is operated in accordance with the weaving condition and the operating condition as set in advance, while the weaving process goes on.

6 Claims, 4 Drawing Sheets

METHOD AND APPARATUS FOR DRIVING SELVEDGE FORMING DEVICE IN WEAVING MACHINE

BACKGROUND OF THE INVENTION

1. Field of the Invention

The present invention relates to a method and an apparatus for driving a selvedge forming device of the tuck-in type capable of cutting a weft beaten by a reed and tucking the end portion of the cut weft in a warp shed.

2. Prior Art

There has been proposed a tuck-in type selvedge forming technique of this kind which uses a cutter for cutting a weft inserted by weft insertion, a weft holding device for holding the end portion of the cut weft by means of an air stream, and a tuck-in needle for use in tucking the end portion of the cut weft in a warp shed (see Japanese Patent Application Public Disclosure (KOKAI) No. 62-53450). In this prior art, each of the selvedge forming parts (selvedge forming elements) contributing to the selvedge formation, for instance, a cutter, a weft holder, a tuck-in needle, and so forth are respectively operated at a predetermined constant timing. If the type of weft is changed, the air supply pressure is regulated so as to meet this weft change.

Furthermore, there has been proposed another tuck-in type selvedge forming technique which uses an electromagnetic actuator for operating at least one of the selvedge forming elements including a weft holding device, a cutter and parts as used for tuck-in operation, and an operating instruction device for outputting a signal for keeping the electromagnetic actuator in the operable or inoperable state according to a pile weaving signal from a weaving pattern control device of the weaving machine and a rotational angle signal which is the rotational angle of the main shaft of the weaving machine (see Japanese Patent Application Public Disclosure (KOKAI) No. 2-112446). In this prior art, during the pile weaving process, the selvedge forming elements are operated only in a pile weaving cycle next to the preceding one, whereby a plurality of wefts inserted by weft insertion while the selvedge forming elements are in the inoperable state are tucked in all together, and the selvedge forming elements are operated every weft insertion during the non-pile weaving process forming no pile, whereby wefts are tucked in on a weft-by-weft basis.

There has been proposed still another tuck-in type selvedge forming technique wherein, during the pile weaving process, a plurality of wefts are tucked in all together in the pile weaving cycle next to the preceding one, and during the non-pile weaving process forming no pile, the weft is tucked in every weft insertion (see Japanese Patent No. 2,501,845). In this prior art, the driving of the selvedge forming elements is stopped in correspondence to the weaving structure, that is, the weaving condition.

In all cases of the prior art as described above, however, the operating condition (tuck-in condition) for actually operating the selvedge forming elements is not only unchanged in the process of tucking the weft in the warp shed, but also unchanged even if the weaving condition is switched. Like this, in the prior art as described above, the condition for actually operating the selvedge forming elements is unchanged even though the weaving condition is switched, so that it possibly occurs that some selvedge structures are formed under an inappropriate operating condition, thus coming to form a selvedge structure lacking in uniformity.

Especially, in cases of high value added fabrics, they have to be woven by taking into account various factors and operating conditions, for instance the type of weft [as] used, a position of the cloth fell (influenced by the weft (pick) density, the fabric structure, the circumstances of the warp shed, etc.), the rotational speed (or number) of the weaving machine and so forth. In addition to these, the high value added fabric has to be woven by changing the weaving condition such as the operation or non-operation of the selvedge forming elements, in accordance with the weaving pattern. Accordingly, it is hardly possible for the prior art as described above to provide the high value added fabric having a uniform selvedge structure.

In the case of a selvedge forming device of the type wherein fluid like air or water is used for holding the weft or tucking the weft end portion in the warp shed, the excess and insufficiency in the operating condition with respect to the weft end portion to be tucked in the warp shed has a great influence on formation of the selvedge structure. For instance, insufficient air jetting results in tuck-in failure caused by incomplete tuck-in operation, while excessive air jetting possibly damages the weft and/or the warp forming the warp shed, thus resulting in fabric defect in either case.

Accordingly, what is important is to form a uniform tuck-in type selvedge structure without being influenced by switching of the weaving condition.

SUMMARY OF THE INVENTION

A driving method and apparatus according to the invention are applied to a technique for driving a selvedge forming device which is fitted to a weaving machine of the type capable of varying its weaving condition according to switching of a weaving pattern, and is used for cutting a weft beaten by a reed and tucking the end portion of the cut weft in a warp shed.

A method for driving the selvedge forming device according to the invention includes the steps of setting in advance an operating condition for operating at least one of a plurality of selvedge forming elements contributing to the selvedge formation in correspondence to the weaving condition; and operating the selvedge forming device according to the weaving condition and the above operating condition as set in advance as well, while the weaving process goes on.

A driving apparatus for driving a selvedge forming device according to the invention includes a setting device for setting in advance an operating condition for operating at least one of a plurality of selvedge forming elements contributing to the selvedge formation in correspondence to the weaving condition; and a driving circuit receiving the information relevant to the weaving condition and driving the selvedge forming device according to the information as inputted and the above operating condition as set in advance as well.

DETAILED DESCRIPTION OF THE PREFERRED EMBODIMENTS

Figure 1:
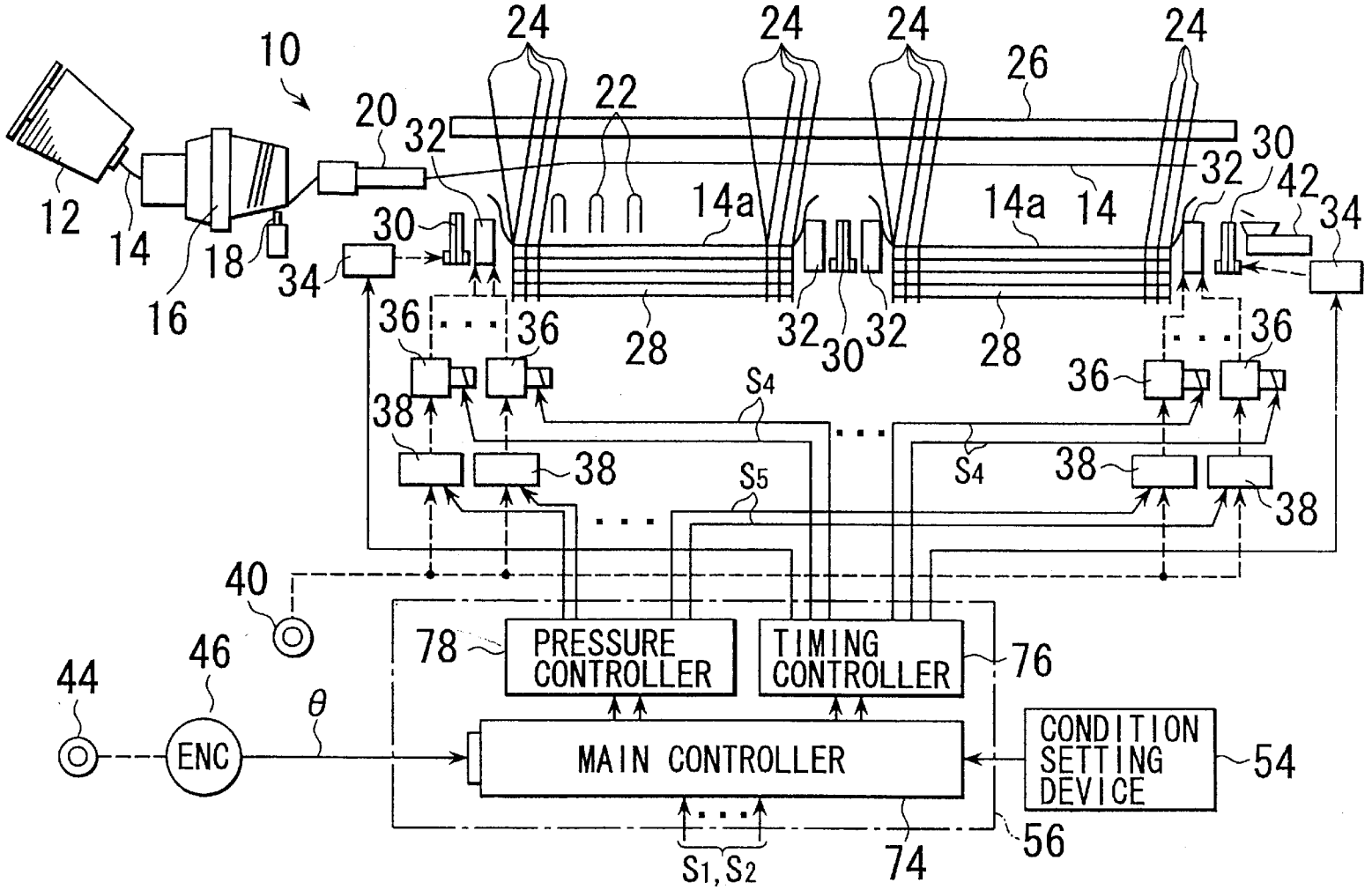
FIG. 1 is an illustration showing an embodiment of a weaving machine provided with a tuck-in type selvedge forming device according to the invention.

As noted, the present invention is directed to a driving apparatus for driving a selvedge forming device for use with a weaving machine, as well as a method for driving the selvedge forming device with a driving apparatus. The weaving machine is of the type capable of varying a weaving condition thereof in response to switching of a weaving pattern. The invention involves setting of an operating condition for operating one of the selvedge forming elements based on the weaving condition.

The weaving machine may be a shuttleless loom, that is, a fluid jet loom jetting a fluid like air or a liquid, a rapier loom using a rapier gripper or the like, and further, may be a pile fabric loom. In this case, switching of the weaving condition may be judged or recognized based on switching of the weaving condition itself, switching (change) of the value of the weaving condition, switching instruction of the weaving condition, or the like.

The weaving condition is the condition that is set in advance for the weaving machine in order to form an objective fabric. As examples of such weaving condition, there may be listed a parameter relating to the weft, a parameter relevant to the position of the cloth fell, a parameter relevant to the warp shed, an operating state of the selvedge elements, that is, let it be operated or not, the rotational speed of the weaving machine, and so forth.

As a parameter relating to the weft, there may be listed the material, thickness and shape of the weft, a type of yarn determined depending on the manufacturing process thereof, the number of wefts inserted in one warp shed when periodically inserting a plurality of wefts in the same warp shed by weft inserting, and so forth.

By the position of the cloth fell is meant the position of the weft inserted and beaten immediately before. As a parameter relating to such cloth fell position, there may be listed a weft (pick) density of the weft (take-up velocity of the woven cloth), a fabric structure (weft density is varied depending on the warp shed pattern and difference in the fabric structure, for instance a plain weave, a twill weave, a satin weave, and an unusual weave, and so forth), a weaving instruction (a pile weaving instruction and a non-pile weaving instruction in the pile weaving machine are relevant to the weft density), a distance between the reed and the cloth fell in the repetitive pile formation by a pile fabric loom (the woven cloth moving type pile fabric loom forms the pile by weft inserting and beating, displacing the woven cloth back and forth periodically. The height of the pile depends on the amount of this displacement, i.e., the above distance), and so forth.

As a parameter relating to the warp shed, there may be enumerated a rotational speed of the weaving machine which varies the period of time for the warp shed to be kept open (the timing for driving the selvedge forming device is controlled by the rotational angle of the main shaft of the weaving machine, so that the operating time of the selvedge forming device is varied depending on the rotational speed of the main shaft), an opening curve of the warp shed, a width of the warp shed, and the number of cycles per repetition (all of these influence the working force given to the weft when tucking the weft in the warp shed, the force varying depending on the open state of the warp shed).

As an operating condition (tuck-in condition) for actually operating the selvedge forming elements, there may be enumerated a timing for starting the operation of the selvedge forming elements contributing to the selvedge formation, that is, a cutter, a device for holding the weft, a device for tucking the weft in the warp shed and so forth, a timing for terminating the operation of the selvedge forming elements, an operating duration for actually operating the selvedge forming elements, a force actually imposed on the weft by the selvedge forming elements (for instance, an air jet pressure in case of the air jet type selvedge forming elements), and a ratio between the number of executions of the weft inserting and the number of operations of the weft tuck-in device.

In case of tucking the end portions of a plurality of wefts in the warp shed all together at one time, the operating condition may be set, for instance, such that the more wefts to be tucked in, the longer the period of time for jetting the fluid is or the higher the fluid jet pressure is made.

A type of weft and the rotational speed of the weaving machine as the weaving condition may be replaced by other elements constituting each parameter as mentioned above (for instance, the number of wefts), other parameters relevant to the cloth fell (for instance, the weft density), and combination of a plurality of parameters.

As described above, if the operating condition for operating the selvedge forming elements is set in advance in correspondence to the weaving condition, and the selvedge forming device is operated in accordance with the weaving condition and the above operating condition as set in advance during the weaving process, there will be remarkably reduced tuck-in failure and damage of wefts and warps located at and near the warp shed portion, which might be caused in the prior art weaving process carried out only on the basis of a single operating condition, and thus the tuck-in type uniform selvedge structure is formed without being influenced by switching of the weaving condition and the quality of the woven cloth is improved very much.

The selvedge forming elements include a cutter for cutting the weft inserted by weft insertion, and the timing of cutting the weft can be used as the above operating condition to be set. The selvedge forming elements further include a weft holding device for holding the weft at least until starting the tuck-in operation for tucking the end portion of the cut weft in the warp shed, and the operating condition of the weft holding device can be used as the above operating condition to be set.

In the latter case, the weft holding device includes one or more weft holding nozzles for holding the weft by a gas or fluid jet, and at least one selected from a group of the timing of starting the fluid jet ejected out of the holding nozzle, the timing of terminating the fluid jet, and a fluid jet pressure, can be used as the above operating condition to be set in advance. The holding nozzle as mentioned above is of the type holding the cut weft by bending it in the direction different from its flying direction initially directed to.

Furthermore, the above-mentioned selvedge forming elements include one or more nozzles for tucking the weft in the warp shed by means of a gas or liquid jet, and at least one selected from the group of the timing of starting the fluid jet ejected out of the holding nozzle, the timing of terminating the fluid jet, and a fluid jet pressure, can be used as the above operating condition to be set in advance. In this case, the nozzle may include at least one selected from the nozzle for feeding the weft as held and one or more tuck-in nozzles for tucking the weft as fed in the warp shed.

Still further, the selvedge forming elements include a plurality of holding nozzles for holding the weft by means of a gas or liquid jet or a plurality of nozzles for tucking the weft in the warp shed by a gas or fluid jet, and the above operating condition to be set in advance includes the condition under which at least one of the above nozzles is made to operate while at least one of the other nozzles is made not to operate.

Figure 2:
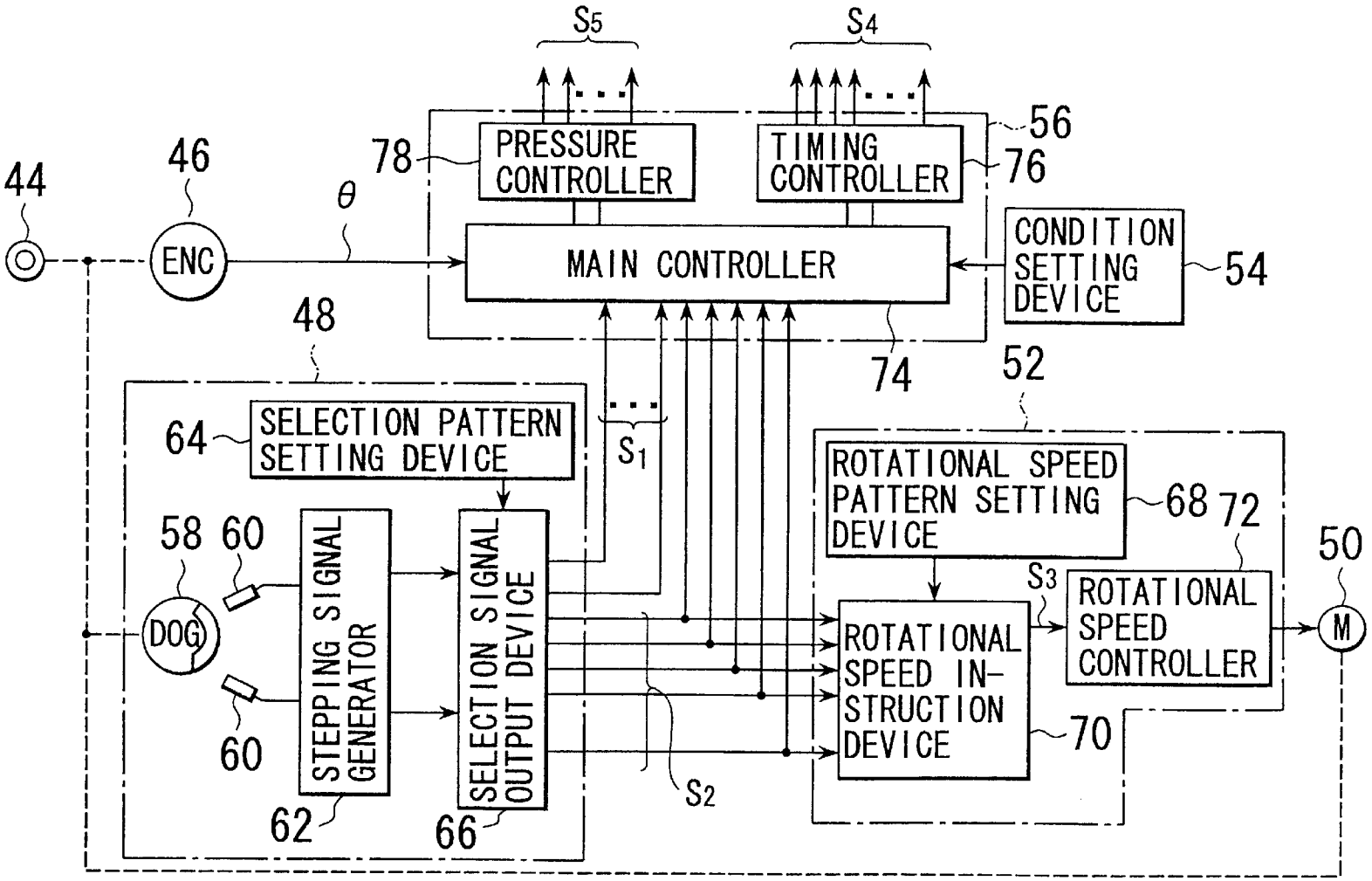
FIG. 2 is a block diagram showing an embodiment of an electric circuit for driving the weaving machine as illustrated in FIG. 1.
Figure 3:
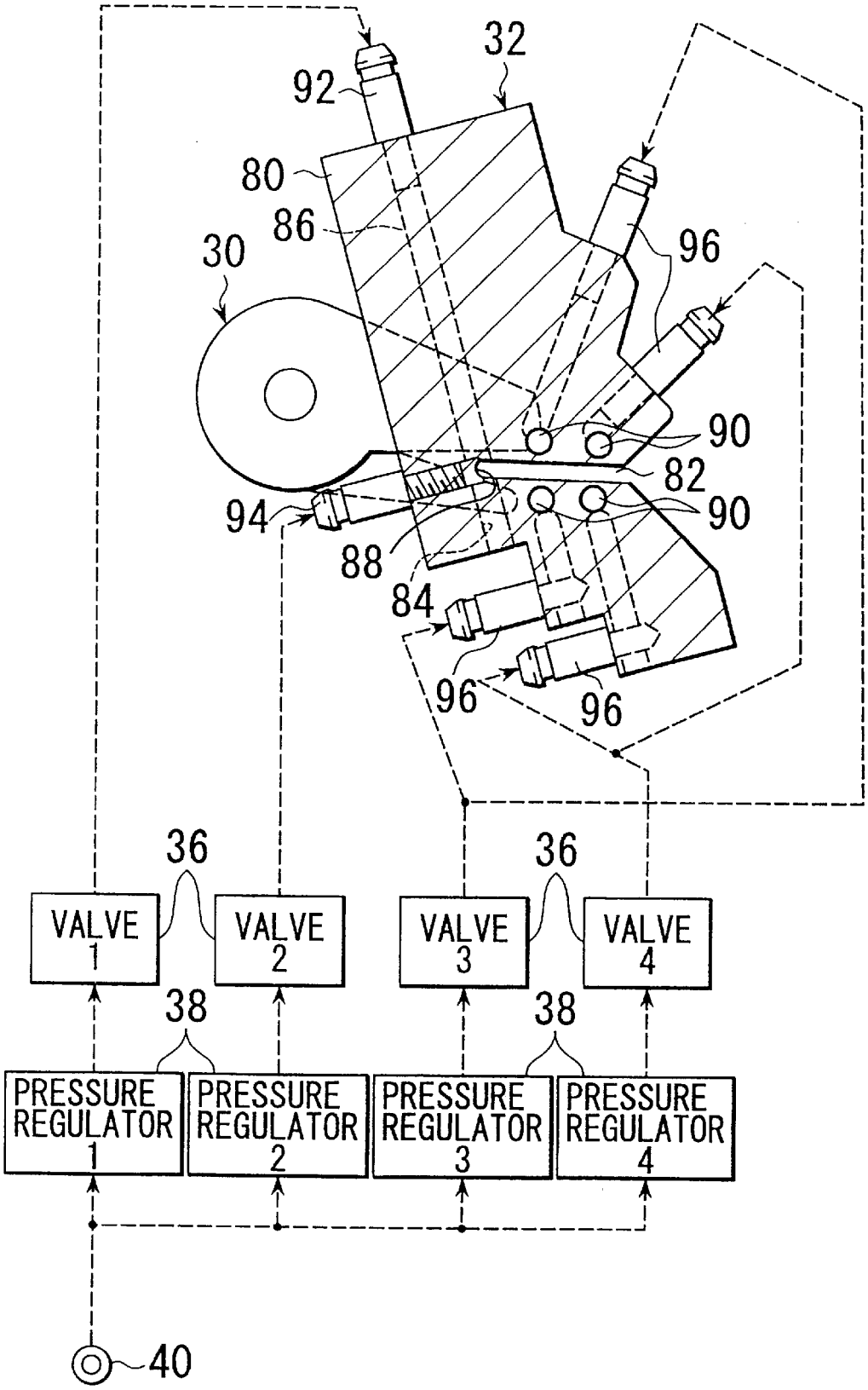
FIG. 3 is an illustration showing an embodiment of a tuck-in type selvedge forming device.
Figure 4:
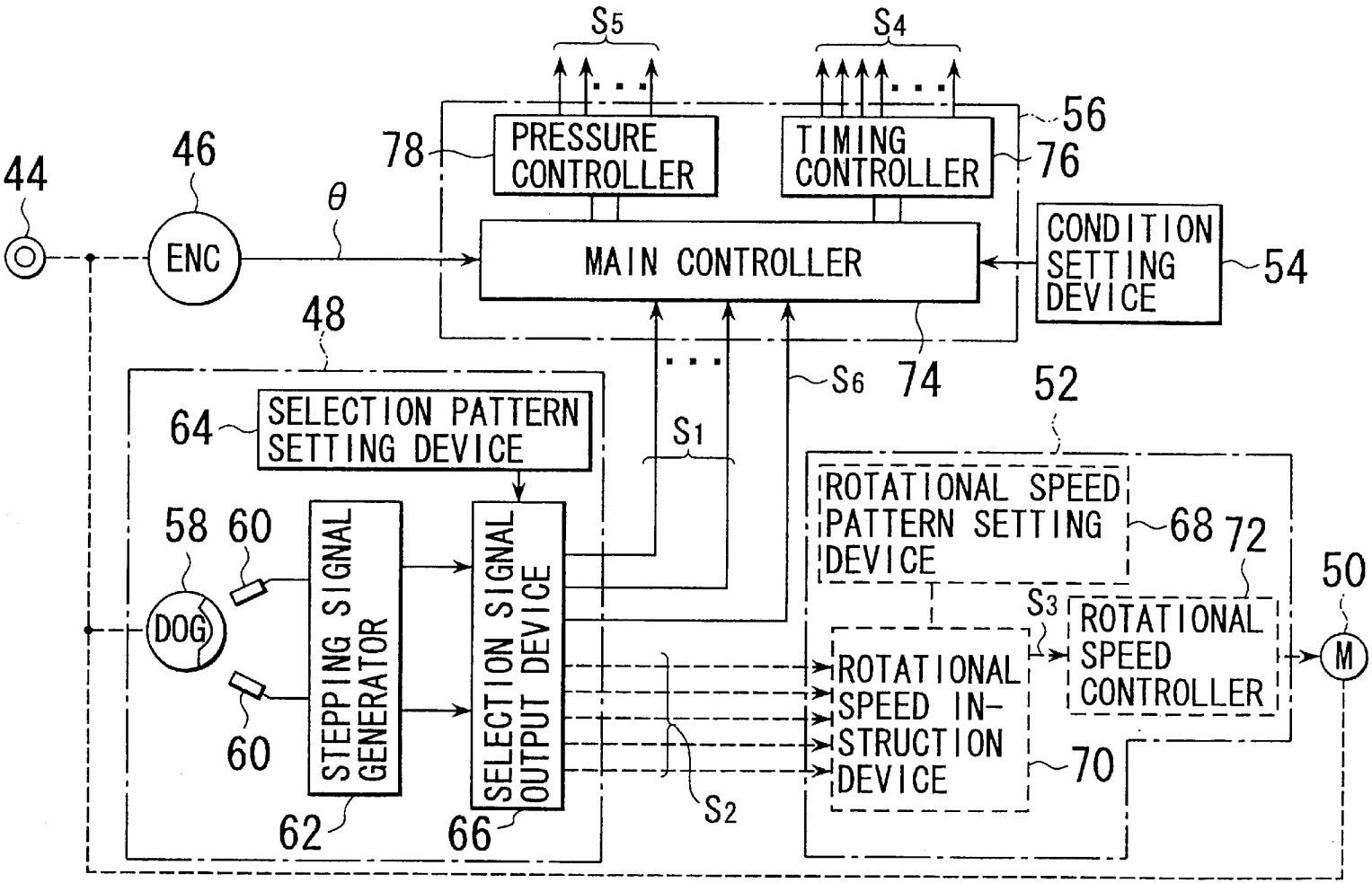
FIG. 4 is a block diagram showing another embodiment of an electric circuit for driving the weaving machine.

FIG. 1 is an illustration showing an embodiment of a weaving machine provided with a tuck-in type selvedge forming device according to the invention;

FIG. 2 is a block diagram showing an embodiment of an electric circuit for driving the weaving machine as illustrated in FIG. 1;

FIG. 3 is an illustration showing an embodiment of a tuck-in type selvedge forming device; and FIG. 4 is a block diagram showing another embodiment of an electric circuit for driving the weaving machine.

Referring to FIGS. 1 and 2, a weaving machine 10 stores a weft 14 rolled around a weft package 12 in a length measuring and storage device 16. The stored weft 14 is then released from the length measuring and storage device 16 by a release pin 18 at a predetermined timing by a predetermined length of the weft equivalent to one pick. The released weft 14 is further inserted in warp sheds formed by a plurality of warps 24 with the help of a main nozzle 20 and a plurality of sub nozzles 22 as well. Finally, the inserted weft 14 is beaten against the cloth fell by a reed 26.

The weaving machine 10 as shown in the figures is a so-called dual type weaving machine capable of weaving two fabrics 28 at the same time, and is provided with a tuck-in type selvedge forming device for each fabric 28 and a driving device for driving each of these tuck-in type selvedge forming device.

Each tuck-in type selvedge forming device is provided with a cutter 30 for cutting the inserted weft and a tuck-in device 32 for holding the end portion of the weft 14 and tucking it in the shed of the warp 24, both being arranged in the vicinity of each end portion of the corresponding woven fabric 28 (side edge of the woven fabric in the widthwise direction thereof).

Each cutter 30 is driven by an electromagnetic actuator 34 such as a rotary solenoid. Each tuck-in device 32 is provided with a weft holding device for holding the inserted weft and a tuck-in device for tucking the cut end of the weft 14 in the shed of the warp 24.

In the example as illustrated, each tuck-in device 32 is of the type wherein its tuck-in function is executed by jetting a fluid like gas or a liquid through a plurality of nozzles. In the following description, air is to be used for such a fluid. Each tuck-in device 32 includes a switching valve 36 for controlling the compressed air supply to the nozzle and a pressure regulator 38 such as a valve means working in proportion to a voltage applied thereto for regulating the air pressure (fluid pressure) supplied to the nozzle. These switching valve 36 and pressure regulator 38 arc prepared for each nozzle.

In the example as illustrated, the cutter 30 located in the center portion is shared by two tuck-in devices 32 arranged on both sides thereof. However, both of the two tuck-in devices 32 arranged in the center portion may be provided with a cutter 30, respectively. Furthermore, in the figure, the switching valve 36 and the pressure regulator 38 for use in both of the tuck-in devices 32 located in the center portion are intentionally not shown to facilitate understanding of the embodiment of the invention.

The pressurized air for use in tuck-in operation is supplied to the pressure regulator 38 from a common pressurized fluid (air) source 40. Weft scrap pieces cut off by the cutter 30 located on the most downstream side in respect of the flying direction of the weft 14 is removed by a suction device 42 from the area where the corresponding cutter 30 is arranged.

The weaving machine 10 makes an encoder 46 detect the rotation of its main shaft 44 and then output a rotational angle signal θ corresponding to the rotational angle of the main shaft 44 to various relevant circuits. Furthermore, a selection signal generator 48 outputs various selecting instruction signals, and a rotational speed controller 52 controls the motor 50 for the main shaft 44, based on the rotational speed selecting instruction S2 outputted from the selection signal generator 48. The motor 50 may be of any general type if it can rotate the main shaft 44.

A driving device for driving the selvedge forming device, according to the example as illustrated, is constituted such that it may change the tuck-in condition (operating condition) in correspondence to a sort of the weft (weft parameter) or switching of the rotational speed of the weaving machine 10. Such a driving device includes a condition setting device 54 in which there is set in advance the condition (tuck-in condition=operating condition) for operating selvedge forming elements actually contributing to the selvedge formation, for instance, a cutter, a weft holding device, a weft tuck-in device for tucking the cut end of the weft in the warp shed and so forth, and a tuck-in controller 56 for controlling the selvedge forming device under a predetermined condition, based on the tuck-in weft selecting instruction S1, the rotational speed selecting instruction S2, and the rotational angle signal θ.

The selection signal generator 48 includes a dog 58 rotated in synchronism with the main shaft 44, a pair of proximity switches 60 for detecting the rotation of the dog 58 every turn thereof, a stepping signal generator 62 for generating a stepping signal corresponding to the weft inserting pick number by counting the output signal from both of the proximity switches 60, a selection pattern setting device 64 in which respective output patterns for various selection signals are set, and a selection signal output device 66 which reads a predetermined pattern which has been already set in the selection pattern setting device 64, based on the output signal from the stepping signal generator 62, and outputs various selecting instructions corresponding to the pattern as has been read.

In the selection pattern setting device 64, there are set output patterns corresponding to various selecting instructions (selection signals) with respect to each weft inserting pick number, these selecting instructions being a weft selecting instruction designating a weft used for weft inserting, a tuck-in weft selecting instruction designating a weft to be tucked in, a rotational speed selecting instruction designating the rotational speed of the main shaft 44, and so forth.

The selection signal output device 66 reads the output pattern corresponding to the weft inserting pick number from the selection pattern setting device 64, based on the stepping signal inputted thereto, and then outputs various selection signals, for instance, the weft selecting instruction, the tuck-in weft selecting signal instruction S1, the rotational speed selecting instruction S2 and so on, based on the output pattern as has been read. In the example as illustrated, the tuck-in weft selecting instruction S1 is supplied to the tuck-in controller 56 while the rotational speed selecting instruction S2 is supplied to the rotational speed controller 52 and the tuck-in controller 56 as well.

The selection signal generator 48 as described above may be constituted by using a pattern controller such as an electronic dobby. The weft selecting instruction is supplied to various machinery related to the weft inserting, for instance, the length measuring and storage device 16, the weft inserting device, the driving devices therefor and so forth, some of which are not shown.

The rotational speed controller 52 includes a rotational speed pattern setting device 68 in which various rotational speed patterns used for controlling the main shaft motor 50 are set for each weft inserting pick number or each rotational speed selecting instruction S2, a rotational speed instruction device 70 which reads the rotational speed pattern corresponding to the inputted rotational speed selecting instruction S2 from the rotational speed pattern setting device 68 and outputs a rotational speed instruction S3 corresponding thereto, and a rotational speed controller 72 controlling the rotational speed of the main shaft motor 50, based on the rotational speed instruction S3 outputted from the rotational speed instruction device 70.

The rotational speed instruction device 70 reads the rotational speed pattern corresponding to the inputted rotational speed selecting instruction S2 from the rotational speed pattern setting device 68 with respect to each weft inserting pick and outputs the rotational speed instruction S3 corresponding to the read rotational speed pattern with respect to each weft inserting pick.

The rotational speed instruction device 70 outputs an instruction for accelerating or decelerating the rotational speed of the main shaft motor 50, or keeping it constant. Accordingly, the rotational speed controller 72 rotates the main shaft motor 50 such that its rotational speed corresponds to the rotational speed selecting instruction S2.

The tuck-in condition (operating condition) as set in the condition setting device 54 is the condition for actually operating selvedge forming members (selvedge forming elements) contributing to the tuck-in selvedge formation, for instance, the operating condition of the cutter 30, the condition relating to the fluid jet ejected out from the weft holding device and the weft tuck-in device, and so forth. These tuck-in conditions are set in correspondence to the rotational speed of the main shaft 44 with respect to each sort of weft and each rotational speed of the weaving machine as well.

The tuck-in condition of the cutter 30 includes the open (cutting) timing, the closing timing, the number of cuttings by the cutter 30, etc. The condition relating to the fluid jet ejected out from the weft holding device and the weft tuck-in device includes the start and end timings of the fluid jet, the fluid jet pressure, the fluid jet pattern, and so forth.

The following is an example of the concrete tuck-in condition according to a sort of the weft.

In case of using a relatively thicker weft, in order to ensure the tuck-in operation of the weft, the cut timing is made quicker, the weft holding timing and the weft tuck-in timing are made quicker, the fluid ejecting duration from each nozzle for holding and tucking the weft in the warp shed is made longer, the fluid pressure is made higher, or the number of nozzles for fluid jet is increased.

In case of a relatively thinner weft, in order to prevent wefts and warps located at and near the shed portion from being damaged, the cut timing is made slower, the weft holding timing and the weft tuck-in timing are made slower, the fluid ejecting duration from each nozzle for holding and tucking the weft in the warp shed is made shorter, the fluid pressure is made lower, or the number of nozzles for fluid jet is decreased.

In case of cutting the weft by the cutter 30, if the weft is relatively thick or difficult to cut, the number of cuttings by the cutter 30 may be increased, thereby ensuring the complete cutting of the weft. To the contrary, if the weft is relatively thin or easy to cut, the number of cuttings by the cutter 30 may be decreased.

The selvedge formation device is driven in correspondence to the rotational angle of the main shaft 44, so that it is preferable to set the driving condition for the selvedge forming device, taking account of the fact that the duration for actually operating the selvedge forming members (for instance, the duration for jetting the fluid) varies depending on the rotational speed of the main shaft 44. For instance, various tuck-in conditions as mentioned above may be set with respect to each of rotational speeds as set in advance. Furthermore, in such a case as the rotational speed is changed while the selvedge formation process goes on, it is possible to set the tuck-in condition as mentioned above in correspondence to the degree (gradient) of change in the rotational speed.

The tuck-in controller 56 includes a main controller 74 which reads a predetermined tuck-in condition from the condition setting device 54 by using the tuck-in weft selecting instruction S1 and the rotational speed selecting instruction S2 as well, and outputs the timing control signal S4 and the pressure control signal S5 corresponding to the read tuck-in condition in response to the rotational angle signal θ, a timing controller 76 for controlling various selvedge forming members by using the timing control signal S4, and a pressure controller 78 for controlling the pressure regulator 38 by using the pressure control signal S5.

The main controller 74 recognizes the change of the weaving condition, based on the selecting instruction S1 or S2, reads a predetermined tuck-in condition from the condition setting device 54 by using the selecting instructions S1 and S2 whenever at least one of the weaving conditions is switched, produces the timing control signal S4 and the pressure control signal S5 in correspondence to the predetennined tuck-in condition as read above, and finally outputs the timing control signal S4 and the pressure control signal S5 as produced above to the timing controller 76 and the pressure controller 78, respectively, in response to the rotational angle signal θ. These control signals S4 and S5 are maintained until the next switching occurs in the weaving condition.

In the weaving machine 10, the weft 14 is inserted in the warp shed by weft inserting with the help of the main nozzle 20 and a plurality of sub nozzles 22. The inserted weft 14 is beaten by the reed 26 with a predetermined tension given and is then cut by the cutter 30. In case of not tucking the end portion of the cut weft in the warp shed, this weft end portion is held by the weft holding device of the tuck-in device 32 until a predetermined period of time has passed away.

In case of tucking the end portion of the cut weft in the warp shed, however, this weft end portion is tucked in the warp shed by the tuck-in device 32 after the next weft inserting. In this case, it is possible to delay outputting of the tuck-in weft selection signal S1 it by one cycle from the corresponding weft selecting signal.

When at least one of the weaving conditions, for instance the sort of the weft, the rotational speed of the main shaft and so forth is changed, the main controller 74 reads a predetermined tuck-in condition from the condition setting device 54 by using the selecting instructions S1 and S2, then produces the control signals S4 and S5 corresponding to the tuck-in condition as read above, and further outputs the produced control signals S4 and S5 in response to the rotational angle signal θ. With this, the weft end portion is driven under a new tuck-in condition suitable for a new weaving condition.

As has been discussed above, according to the preferred embodiment of the invention, it becomes possible to remarkably reduce undesirable phenomena, for instance, the damage given to the weft and the warp shed portion and the tuck-in failure which are caused by setting the tuck-in condition to a single value, so that the uniform tuck-in type selvedge structure is realized, whereby the quality of the woven cloth is highly improved.

FIG. 3 illustrates an example of an air jet type tuck-in selvedge forming device according to the preferred embodiment of the invention. The cutter 30 is provided with a fixed cutting edge and a movable one. The movable cutting edge is driven by an actuator (not shown) relative to the fixed cutting edge, thereby cutting the weft. The tuck-in device 32 includes a plate-type block unit 80.

The block unit 80 includes a lying U-shaped slit 82 for accepting the weft beaten by the reed. This slit 82 is opened in three directions, that is, the first opening directing to the front side facing to the reed, the second one to the side of the warp 24, and the third one to the side of the cutter 30. The slit 82 is formed extending in the direction along the warp line while its deep inner portion is on an extension line of the cloth fell.

Furthermore, the block unit 80 includes a capture nozzle 84 extending downward from the deep inner portion of the slit 82, a weft holding nozzle 86 extending upward from the deep inner portion of the slit 82, a weft advancing nozzle 88 communicated and connected with the deep inner portion of the slit 82 and opened toward the front, and a plurality of guide nozzles 90 arranged on upper and lower sides of the slit 82 and directed to the weave edge of the woven cloth. The weft holding nozzle 86, weft advancing nozzle 88 and guide nozzles 90 are respectively connected with a pressurized fluid source 40 through corresponding nipples 92, 94 and 96, and through predetermined switching valves 36 and pressure regulators 38.

In the example as illustrated in FIG. 3, plural guide nozzles 90 are respectively connected with the pressurized fluid source 40 through different circuit systems including the switching valve 36 and the pressure regulator 38 in correspondence to their positional relation with respect to the cloth fell. However, these circuit systems may be further divided into other different circuit systems in correspondence to the upper and lower positional relation of guide nozzles. Furthermore, it is possible to use either the switching valve 36 or the pressure regulator 38 in common with the other guide nozzle, thereby simplifying the circuit system configuration.

The end portion of the weft inserted by weft inserting is accepted in the slit 82 when beating it by the reed. The weft end portion accepted in the slit 82 is cut by the cutter and is then blown into a capture nozzle 84 and bent by the air jet ejected from the capture nozzle 84 through the weft holding nozzle 86 and the slit 82, to be held in the tuck-in device 32.

In the process of tucking the weft end portion in the warp shed, the weft end portion held in the tuck-in device 32 is advanced forward through the inside of the slit 82 by the air jet ejected from the weft advancing nozzle 88 to the inside of the slit 82 and is then blown into the warp shed by the air jet ejected from one or more guide nozzles. In this way, the weft end portion is tucked in the warp shed at the side edge of the woven cloth and then woven therein.

In the embodiment described in the above, the tuck-in condition has been set corresponding to both of the sort of the weft 14 and the rotational speed of the weaving machine. However, if it is possible to neglect the influence given by switching of the weaving condition on the tuck-in function, the tuck-in condition may be set on the basis of either the sort of the weft or the rotational speed of the weaving machine.

Furthermore, the above weaving condition, that is, a sort of the weft and the rotational speed of the weaving machine may be replaced by other element constituting each of the above parameters (e.g., the number of weft to be tucked in), the parameter relating to the cloth fell position (e.g., weft density), and so forth, or replaced by combination of these parameters.

For instance, when the weft end portion is retained in the woven cloth, the position of this weft end portion is varied, depending on the change of the cloth fell position, while the position of the tuck-in type selvedge forming device takes a fixed position in the weaving machine. Consequently, if the cloth fell position varies, a positional disagreement is caused between the weft and the tuck-in type selvedge forming device, and thus the tuck-in operation sometime results in failure. Accordingly, it is preferable to change the tuck-in condition (operating condition) of the selvedge forming elements in response to switching of the cloth fell position.

The tuck-in condition may be changed so as to quickly respond to switching of the weaving condition. However, there occurs such a tuck-in failure that comes out when a certain time has passed away after switching the weaving condition, for instance a tuck-in failure caused by the change of the cloth fell position comes out when having beaten several picks after switching the weft density. In order to deal with the tuck-in failure of this kind, the tuck-in condition may be switched after a predetermined passage of time (for instance, after executing the weft inserting of several picks).

As concrete examples of the tuck-in condition for coping with the positional variation of the cloth fell, there can be enumerated a timing of cutting the weft by the cutter, a timing of jetting the fluid, a fluid jet pressure, a fluid jet pattern, and so forth. It is preferable, as indicated in FIG. 3, to arrange a plurality of weft holding nozzles 86 and weft guide nozzles 90 in the direction toward the cloth fell position (i.e. transmitting direction of the warp and the woven cloth) and to operate predetermined nozzles at a predetermined timing in response to the change of the cloth fell position.

FIG. 4 indicates another embodiment according to the invention wherein, in order to improve an appearance of the selvedge structure, the tuck-in operation is periodically paused for certain weft inserting picks.

In the embodiment as shown in FIG. 4, the number of wefts to be tucked in (a parameter relevant to the weft) immediately after restarting the tuck-in operation is varied by having the tuck-in operation pause for the predetermined weft inserting picks. For this reason, the tuck-in condition corresponding to this parameter is set in advance in the condition setting device 54 in correspondence to the number and the sort of the weft to be tucked in. On one hand, the tuck-in inoperable pattern is set in advance in the selection pattern setting device 64.

The selection signal generator 48 reads the tuck-in inoperable pattern from the selection pattern setting device 64 and gives it to the selection signal output device 66, which in turn supplies an on-state tuck-in inoperable instruction S6 to the main controller 74. The tuck-in inoperable instruction S6 is a signal relevant to the number of wefts to be finally tucked in all together. The output pattern of the tuck-in inoperable instruction S6 may be arbitrarily changed so as to meet the requirement of an objective fabric.

Having received the on-state tuck-in inoperable instruction S6, the main controller 74 puts pause to the operation of the selvedge forming elements and counts the number of picks in the duration of this pause. When the tuck-in inoperable instruction S6 is turned off, the main controller 74 selects a tuck-in condition corresponding to the number of wefts to be tucked in, on the basis of the number of picks as counted above, and then outputs control signals which meet the selected tuck-in condition to the timing controller 76 and the pressure controller 78, respectively.

Similar to the embodiment shown in FIGS. 1 and 2, it is allowed for the embodiment shown in FIG. 4 to make use of the combination of one or more other parameters, for instance, the rotational speed, the weft density, and so forth.

In the embodiment as mentioned above, switching of the weaving condition is recognized on the basis of the weaving condition selection signal. However, this switching of the weaving condition may be recognized on the basis of the change in the value of the weaving condition. Since the pattern as set in the selection pattern setting device 64 is set in correspondence to the weft inserting pick number, the tuck-in condition may be selected, based on the weft inserting pick number by letting the tuck-in condition correspond to the weft inserting pick number.

In the tuck-in device for forming the center selvedge, the weft holding device may be omitted by setting both of the timing of cutting by the cutter and the start timing of the tuck-in operation by the tuck-in device to approximately the same timing. In this case, the tuck-in condition may be set with regard to either of the above two timings.

The weft holding device may be of the type capable of grasping the weft end portion by means of a mechanical member. The weft tuck-in device may be of the type capable of tucking the weft end portion in the warp shed by means of a mechanical member such as a needle. In this case, the mechanical member may be arranged such that it is operated with an electric actuator running in synchronism with the rotation of the main shaft of the weaving machine. The driving pattern (driving curve to the main shaft) of the actuator may be changed in correspondence to switching of the weaving condition.

Instead of using the pressure regulator, it is possible to use a plurality of pressure sources capable of supplying different pressures. In this case, each of the selvedge forming elements is connected with the pressure source supplying the pressure according to the operating condition as set, thereby varying the fluid jet pressure. Furthermore, the function of the main controller 74 and the functions of controllers 76 and 78 may be executed by using a common computer. Still further, in addition to these functions, the function of the selection signal generator 48 (especially, selection signal output device 66) and the function of the rotational speed controller 52 (especially, rotational speed instructor 70) may be executed by using a common computer.

The invention has been described in detail by way of preferred embodiments as illustrated in the accompanying drawings, but the invention is not limited by these embodiments. It is understood that anyone having an ordinary skill in the art makes variations and modifications of the invention without departing from the gist of the invention.

What is claimed is:

1. A method for driving a selvedge forming device which is fitted to a weaving machine and is used for cutting a weft beaten by a reed and tucking the end portion of the cut weft in a warp shed, said weaving machine being of the type capable of varying a weaving condition thereof in response to switching of a weaving pattern, said method comprising the steps of:

setting in advance an operating condition in a setting device for operating at least one of a plurality of selvedge forming elements contributing to the selvedge formation in correspondence to said weaving condition; and operating said selvedge forming device according to said weaving condition and said operating condition as set in advance, while the weaving process is going on.

2. A driving method as claimed in claim 1, further comprising providing said selvedge forming elements with a cutter for cutting said weft, and further using a timing of cutting said weft by said cutter to define said operating condition as set in advance.

3. A driving method as claimed in claim 1, further comprising providing said selvedge forming elements with a weft holding device for holding said weft at least until starting of an operation for tucking said weft in said warp shed, and further using an operating condition for operating said weft holding device to define said operating condition as set in advance.

4. A driving method as claimed in claim 1, further comprising providing said selvedge forming elements with at least one nozzle for tucking said weft in said warp shed by means of a fluid jet, and further using at least one operating condition selected from a group consisting of a timing of starting said fluid jet, a timing of terminating said fluid jet, and a jet pressure of said fluid to define said operating condition as set in advance.

5. A driving method as claimed in claim 1, further comprising providing said selvedge forming elements with at least one of a group of a plurality of nozzles for holding said weft by means of said fluid jet and a plurality of nozzles for tucking said weft in said warp shed by means of a fluid jet, and further using a condition under which at least one of said nozzles is operated while at least one of said other nozzles is not operated to define said operating condition as set in advance.

6. A driving apparatus for driving a selvedge forming device which cuts a weft beaten by a reed and tucks the end portion of the cut weft in a warp shed, the driving apparatus adapted to be fitted to a weaving machine of the type capable of varying the weaving condition thereof according to a weaving pattern, the driving apparatus comprising:

a setting device for setting in advance an operating condition for operating at least one of a plurality of selvedge forming elements contributing to the selvedge formation in correspondence to said weaving condition; and a driving circuit receiving the information relevant to said weaving condition and driving said selvedge forming device according to said information as received and said operating condition as set in advance.

* * * * *

UNITED STATES PATENT AND TRADEMARK OFFICE

CERTIFICATE OF CORRECTION

PATENT NO. : 6,325,111 B2
DATED : December 4, 2001
INVENTOR(S) : Akihiko Nakada et al.

It is certified that error appears in the above-identified patent and that said Letters Patent is hereby corrected as shown below:

Column 5,
Lines 1-10, delete text in its entirety.
Line 49, “arc prepared” should read -- “are prepared --.

Column 8,
Line 53, “it by one” should read -- by one --.

Column 9,
Line 48, after “by the cutter” insert -- 30 --.

Column 10,
Line 15, “sometime” should read -- sometimes --.

Signed and Sealed this

Fifteenth Day of April, 2003

JAMES E. ROGAN
*Director of the United States Patent and Trademark Office*